US008082717B2

(12) United States Patent
Dammers

(10) Patent No.: US 8,082,717 B2
(45) **Date of Patent: *Dec. 27, 2011**

(54) PANEL, IN PARTICULAR FLOOR PANEL

(76) Inventor: Dirk Dammers, Neukirchen-Vluyn (DE)

( * ) Notice: Subject to any disclaimer, the term of this patent is extended or adjusted under 35 U.S.C. 154(b) by 675 days.

This patent is subject to a terminal disclaimer.

(21) Appl. No.: 11/921,840

(22) PCT Filed: Mar. 6, 2006

(86) PCT No.: PCT/EP2006/002033

§ 371 (c)(1),
(2), (4) Date: Dec. 5, 2007

(87) PCT Pub. No.: WO2006/131160

PCT Pub. Date: Dec. 14, 2006

(65) Prior Publication Data

US 2010/0154343 A1 Jun. 24, 2010

(30) Foreign Application Priority Data

Jun. 6, 2005 (DE) ..... 10 2005 026 157
Jun. 6, 2005 (DE) ..... 20 2005 008 917 U
Jun. 8, 2005 (DE) ..... 10 2005 026 554

(51) Int. Cl.
*E04B 2/00* (2006.01)

(52) U.S. Cl. ..... 52/588.1; 52/390; 52/539; 52/592.2

(58) Field of Classification Search ..... 52/578, 52/588.1, 582.1, 586.1, 586.2, 590.1, 590.2, 52/592.2, 390, 539, 592.1, 392, 533, 534, 52/553, 589.1, 590.3, 591.1–591.5, 592.4
See application file for complete search history.

(56) References Cited

U.S. PATENT DOCUMENTS

| | | | | |
|---|---|---|---|---|
| 213,740 | A * | 4/1879 | Conner | 52/503 |
| 1,723,306 | A | 8/1929 | Sipe | |
| 2,004,193 | A | 6/1935 | Cherry | |
| 2,534,458 | A | 12/1950 | Larrabee | |
| 2,835,172 | A | 5/1958 | Barker et al. | |
| 2,915,095 | A | 12/1959 | Pelto | |
| 2,944,466 | A | 7/1960 | Rohlfs | |

(Continued)

FOREIGN PATENT DOCUMENTS

| | | |
|---|---|---|
| DE | 42 42 530 | 6/1994 |

(Continued)

*Primary Examiner* — Eileen D Lillis
*Assistant Examiner* — Theodore Adamos
(74) *Attorney, Agent, or Firm* — Berenato & White, LLC

(57) ABSTRACT

The invention relates to a panel having means for the detachable connection of adjacent panels by means of pivoting, the means provided comprising, on a first edge, a projecting tongue (3) with a lower and upper tongue surface (4, 5) which divides the edge into an upper and a lower edge section (7, 6), the second edge situated opposite the first edge having a groove (8) which corresponds to the tongue of an adjacent panel and which is enclosed by an upper-side and a lower-side panel section, the upper tongue surface having a projection (13) with a contact surface (14) which is directed rearwardly in the direction S of the upper edge section, and the upper-side panel section having on its lower side a recess which at least partially accommodates the projection and which has a complementary surface (16) interacting with the contact surface, the complementary surface interacting with the contact surface of an adjacent panel in the pivoted-in state.

15 Claims, 13 Drawing Sheets

U.S. PATENT DOCUMENTS

| | | | | |
|---|---|---|---|---|
| 4,422,239 | A | 12/1983 | Maier et al. | |
| 5,010,517 | A | 4/1991 | Migita et al. | |
| 5,025,548 | A | 6/1991 | Justesen | |
| 5,395,188 | A | 3/1995 | Bailey et al. | |
| 5,697,739 | A | 12/1997 | Lewis et al. | |
| 5,850,769 | A | 12/1998 | Lund | |
| 6,006,486 | A | 12/1999 | Moriau et al. | |
| 6,029,416 | A | 2/2000 | Andersson | |
| 6,158,183 | A | 12/2000 | Snell | |
| 6,196,286 | B1 | 3/2001 | Susnjara | |
| 6,421,970 | B1 | 7/2002 | Martensson et al. | |
| 6,510,665 | B2 * | 1/2003 | Pervan | 52/589.1 |
| 6,568,442 | B1 | 5/2003 | Meugniot | |
| 6,584,747 | B2 | 7/2003 | Kettler et al. | |
| 6,592,305 | B1 | 7/2003 | Boisvert | |
| 6,681,820 | B2 | 1/2004 | Olofsson | |
| 6,772,568 | B2 | 8/2004 | Thiers et al. | |
| 6,851,241 | B2 | 2/2005 | Pervan | |
| 6,854,235 | B2 | 2/2005 | Martensson | |
| 6,898,913 | B2 | 5/2005 | Pervan | |
| 6,920,732 | B2 | 7/2005 | Martensson | |
| 6,955,020 | B2 | 10/2005 | Moriau | |
| 7,306,411 | B2 | 12/2007 | Mabuchi et al. | |
| 7,861,483 | B2 | 1/2011 | Dammers | |
| 2003/0024199 | A1 * | 2/2003 | Pervan et al. | 52/589.1 |
| 2003/0106401 | A1 | 6/2003 | Kowalski | |
| 2003/0115821 | A1 * | 6/2003 | Pervan | 52/578 |
| 2003/0233809 | A1 | 12/2003 | Pervan | |
| 2004/0031227 | A1 | 2/2004 | Knauseder | |
| 2004/0128934 | A1 | 7/2004 | Hecht | |
| 2004/0156689 | A1 | 8/2004 | Shen | |
| 2004/0177584 | A1 | 9/2004 | Pervan | |
| 2004/0187423 | A1 | 9/2004 | Weber | |
| 2004/0200175 | A1 * | 10/2004 | Weber | 52/592.1 |
| 2004/0206036 | A1 * | 10/2004 | Pervan | 52/578 |
| 2005/0050827 | A1 * | 3/2005 | Schitter | 52/578 |
| 2005/0138881 | A1 * | 6/2005 | Pervan | 52/578 |
| 2005/0166514 | A1 * | 8/2005 | Pervan | 52/578 |
| 2006/0179773 | A1 * | 8/2006 | Pervan | 52/592.1 |
| 2006/0260254 | A1 * | 11/2006 | Pervan | 52/592.1 |
| 2007/0022695 | A1 | 2/2007 | Magnusson | |
| 2007/0062148 | A1 | 3/2007 | Nienhuis et al. | |

FOREIGN PATENT DOCUMENTS

| | | | |
|---|---|---|---|
| DE | 100 06 748 | | 8/2001 |
| DE | 100 44 967 | | 3/2002 |
| DE | 202 03 977 | | 11/2002 |
| EP | 1 362 947 | | 5/2003 |
| JP | 2002317546 | | 4/2001 |
| WO | WO 9966151 | A1 * | 12/1999 |
| WO | 2004/016876 | | 2/2004 |

* cited by examiner

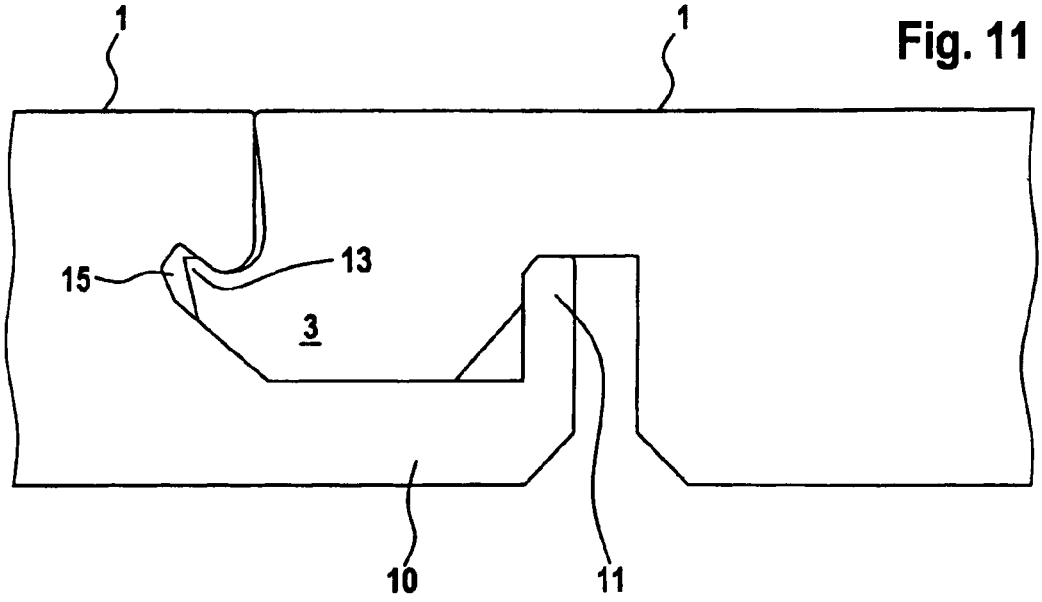
Fig. 11
Fig. 12
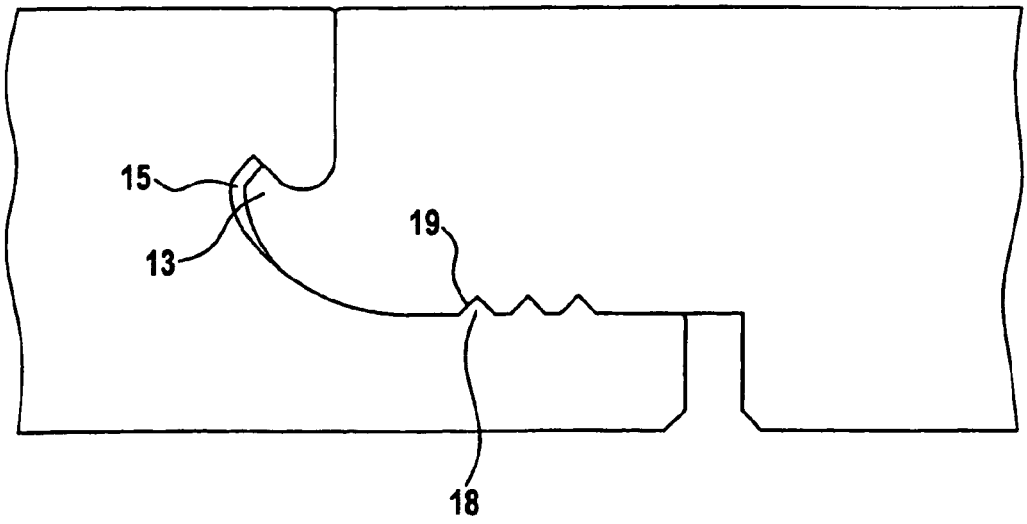

PANEL, IN PARTICULAR FLOOR PANEL

CROSS REFERENCE TO RELATED APPLICATIONS

This application is the US national phase of PCT application PCT/EP2006/002033, filed 6 Mar. 2006, published 14 Dec. 2006 as WO 2006/131160, and claiming the priority of German patent application 202005008917.6 itself filed 6 Jun. 2005, whose entire disclosures are herewith incorporated by reference.

The invention relates to a panel, in particular a floor panel having a top face and a bottom face and means for detachably connecting the panel to adjacent panels by pivoting, the means comprising, on a first longitudinal edge and/or a first transverse edge, a tongue that projects beyond the respective longitudinal and/or transverse edge and has a lower and upper tongue surface that divides the longitudinal and/or transverse edge into a top and a bottom edge portion, the second longitudinal edge and/or second transverse edge situated opposite the first longitudinal edge and/or first transverse edge in each case having a groove that corresponds to the tongue of an adjacent panel of identical design and that is flanked by an upper and a lower panel edge region, the lower panel edge region preferably projecting past to the respective upper panel edge region, and the bottom edge portion preferably being recessed with respect to the top edge portion.

Such panels are usually made of wood or wood materials such as particle board, high-density fiberboard (HDF), or medium-density fiberboard (MDF). The panels are suitable for installing as laminate or parquet floors, or as wall and ceiling panels. Wood materials are usually provided with a top-face decorative layer, which may be a coated or printed decorative paper laminated onto a substrate. For floors, a stabilizing layer is usually applied to the bottom face for equalization of tension. The panel itself may have a single- or multiple-layer design.

Of course, a design is also possible in which the lower and upper panel edge regions are approximately level with each other, and the lower and top edge portions are also approximately level. A design is also possible in which the lower panel edge region is recessed with respect to the upper panel edge region, and the bottom edge portion projects with respect to the top edge portion.

During installation, the panel to be laid is placed, with its edge in the tilted state, against the associated edge of a panel that has already been laid, and is then pivoted downward so that locking is achieved in a direction perpendicular to the top face of the panel and also in a direction perpendicular to the locked side edge of the panel. A disadvantage is that in the pivoted-in state a small gap may remain between the adjacent panels at the top faces.

The object of the invention is to avoid the referenced disadvantage and provide a panel in which a gap-free surface is produced in the connected state with another panel.

This object is achieved by the fact that the tongue on its upper tongue surface has a projection with a contact surface that is directed rearward in the direction S toward the top edge portion, and the upper panel edge region on its bottom face has a recess that at least partially accommodates the projection and that has a countersurface that cooperates with the contact surface, the countersurface in the pivoted-in state cooperating with the contact surface of an adjacent panel so that the panels in the connected state as the result of pivoting in have a connection that is free of play in the direction perpendicular to the orientation of the surfaces, and the panels when connected by pivoting in are pulled together due to the cooperation of the contact surface and countersurface, so that the surfaces in contact in the connected state, i.e. the top edge portion and the upper panel edge region, rest against one another at least in the region of the top face of the panels.

"Directed rearwardly toward the top edge portion" is understood to mean that the contact surface is not oriented parallel to the top face of the panel, and has the normal (N) to the contact surface, viewed from the end of the tongue, on the panel, in particular at an oblique angle set between 0° and 90°.

Because of the cooperation between the contact surface and the countersurface, the panels connected in this manner are pulled together, thus ensuring that the adjacent panels make gap-free contact at the top faces. In the locked state the lower panel edge region is not moved downward relative to the underside of the panel.

The lower tongue surface is designed so that locking is possible by means of a pivot-in motion. Thus, for example, the lower tongue surface has a convex design only at the free end of the tongue, whereas the remaining regions of the lower tongue surface are, for example, planar, preferably parallel to the top face. Beveling is also possible instead of the convex curvature of the tongue at the free end. On its top face the lower panel edge region is thus matched to the shape of the lower tongue surface.

The means may be designed as one piece with the panel. However, a two-piece design is also possible. The means may also be made of a different material, for example plastic, and be attached to the panel in question by an appropriate method such as gluing. The means may also be inserted into a groove in the panel.

The lower panel edge region may have a grooved wall region that projects toward the top face of the panel and that cooperates with an undercut provided on the adjacent panel, in the connected state of the two panels as the result of pivoting in. In this case two adjacent panels are doubly locked, since a positive-fit connection results on the one hand between the projection and the recess, and on the other hand between the lower panel edge region and the undercut.

When the grooved wall region in the pivoted-in state contacts the undercut of the adjacent panel on the top face, the grooved wall region also limits rotation.

Alternatively, the lower panel edge region may have a grooved wall region that projects toward the top face of the panel and that, in the connected state of the two panels as the result of pivoting in, is located in an undercut provided on the adjacent panel without the surfaces of the grooved wall region contacting the corresponding surfaces of the undercut. In this design simple locking, i.e. between the projection and recess, is achieved since the grooved wall region is freely situated in the undercut, and therefore no cooperation occurs in the sense of additional locking.

The projection may have an approximately triangular shape. The projection thus has the shape of an isosceles triangle, so that in this regard the contact surface and the other surface have equal slopes and equal lengths. However, the two surfaces may also have different slopes. The contact surface preferably has a steeper slope than the other surface facing the free end of the tongue.

Alternatively, the projection may have an approximately curved shape. A flattened curvature or a half-moon shape, for example, is possible.

However, the projection may also have an approximately rectangular shape or a flattened trapezoidal shape. Of course, other designs of the projection are also possible.

The shape of the recess is preferably matched to the shape of the projection. However, this is not absolutely necessary. It is important only that in the locked state the projection engages at least partially in the recess. It is therefore possible, for example, for the projection to have a triangular shape, while the recess has a semicircular shape.

The most important consideration for locking is that the contact surface comes into contact with the countersurface when the panel to be installed is pivoted in, thereby pulling the panels together. The interface between the contact surface and the countersurface may be linear, intermittent, or even planar.

The upper panel edge region and/or the top edge portion, at least in a partial region, may have an inwardly extending, in particular recessed, design toward the bottom face, in particular forming a cavity. This prevents formation of a gap on the upper side during use of the installed panels.

The tongue at its lower tongue surface may have a convex curvature, at least in places, the lower panel edge region having a design that conforms to the upper side. This allows uniform pivoting. If a grooved wall region is provided during the pivot motion, this region assists in guiding the panel to be pivoted and installed. Of course, the lower tongue surface may have a convex design over its entire length.

The tongue at its lower tongue surface may have a convex curvature in particular only at its free end. In one such design the convex curvature starts at the lowest point and ascends toward the free end of the tongue.

The convex lower tongue surface may have uniform curvature. In one such design the radius is uniform along the curve.

Of course, other designs are possible in which the circular path of the convex lower tongue surface has different radii. These different radii may have the same center, or may also have different centers.

The lower tongue surface of the tongue may have a support surface oriented essentially parallel to the top face of the panel at the lowest point, i.e. somewhat below the top edge portion, and the lower panel edge region may have a correspondingly oriented planar complementary surface in the region that in the pivoted-in state with an adjacent panel is in contact with the support surface, i.e. somewhat below the upper panel edge region. The convex curvature may merge into the parallel support surface without forming an inflection point. However, it is also possible to have an inflection point in the transition from a convex curvature to a parallel support surface.

The projection may have a surface directed toward the free end of the tongue, and between the surface and the oppositely situated region of the groove may form a free space.

On its lower tongue surface, preferably at its free end, the tongue may also have a locking element, and on its top face the lower panel edge region may have a locking recess that cooperates with the locking element of the adjacent panel when the panels are joined together. This design imparts even greater overall strength to the connection in the pivoted-in state, and makes it more difficult to inadvertently pivot the panel upward.

Alternatively, a reverse configuration may be provided. In this regard the tongue may have a locking recess at its lower tongue surface, preferably at its free end, and on its top face the lower panel edge region may have a locking element that cooperates with the locking recess of the adjacent panel when the panels are joined together.

Of course, a locking element may also be provided on both the lower surface of the tongue and the top face of the lower panel edge region, each locking element being associated with a corresponding locking recess in the top of the lower panel edge region and in the lower tongue surface.

The upper tongue surface may be oriented approximately parallel to the top face of the panel. An angled planar orientation is also possible. However, the upper tongue surface may also have a shape arched toward the top or the bottom face.

The region of the adjacent panel that abuts the upper tongue surface in the pivoted-in state, and that extends between the upper panel edge region and the countersurface of the recess, is designed in such a way that both pivoting in and locking are possible.

The lower tongue surface may have at least one projecting region, and each projecting region in the lower panel edge region may be associated with a corresponding recess that allows a connection of two adjacent panels by pivoting in. Of course, multiple projecting regions may also be provided, each being associated with a recess. As a result of the projecting regions, additional locking may be achieved perpendicular to the top face of the panels, depending on the design of the projecting region.

In addition, a laterally projecting region may be integrally molded onto the top edge portion and/or the upper panel edge region, and a corresponding seat may be provided in the upper panel edge region and/or in the top edge portion.

At the lower tongue surface and/or at the top of the lower panel edge region at least one press-on element may be provided, which in the pivoted-in state of two adjacent panels is in contact with the oppositely situated region of the adjacent panel.

Embodiments of the invention are explained below with reference to the drawings, which show the following:

FIGS. 10-22 show further embodiments in the locked state.

In all the figures, the same reference numerals are used for identical or equivalent components.

The figures illustrate panels having a top face 1 and a bottom face 2. A decorative layer (not illustrated) is usually provided on the top face 1.

Figure 5:
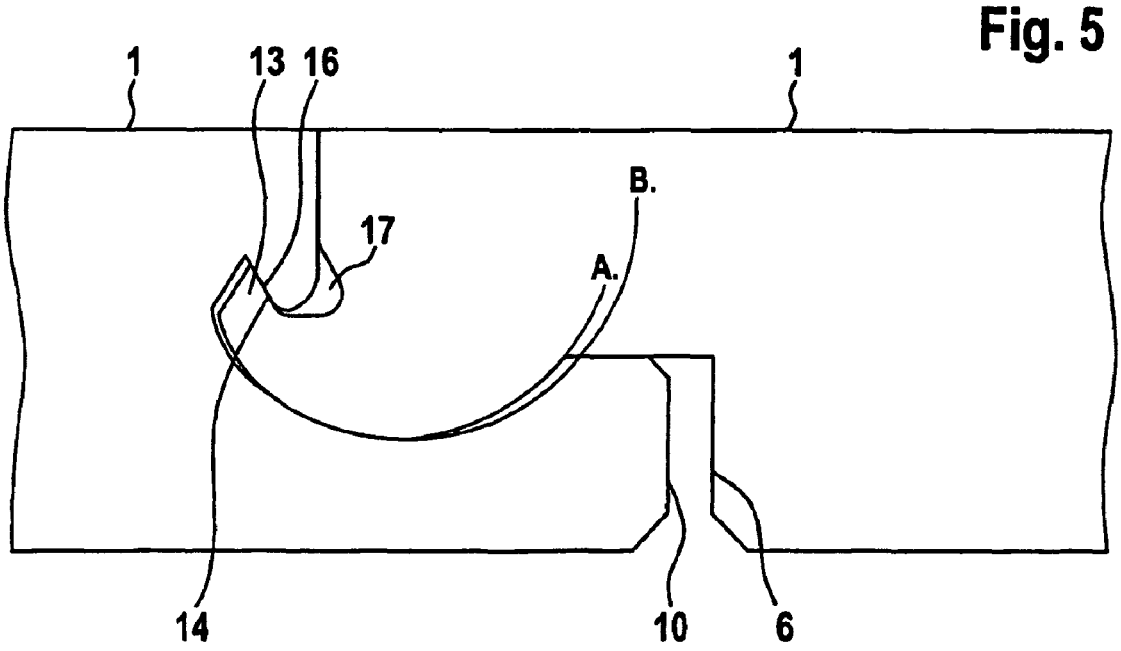

The panels may be used as floor panels, for example. Adjacent panels may be locked together by means of a pivot motion, as illustrated in FIG. 5. The panels have suitable means for locking.

On the first longitudinal edge and/or first transverse edge a tongue 3 is provided that has a lower tongue surface 4 and an upper tongue surface 5 and that projects beyond the respective longitudinal and/or transverse edge.

Figure 1:
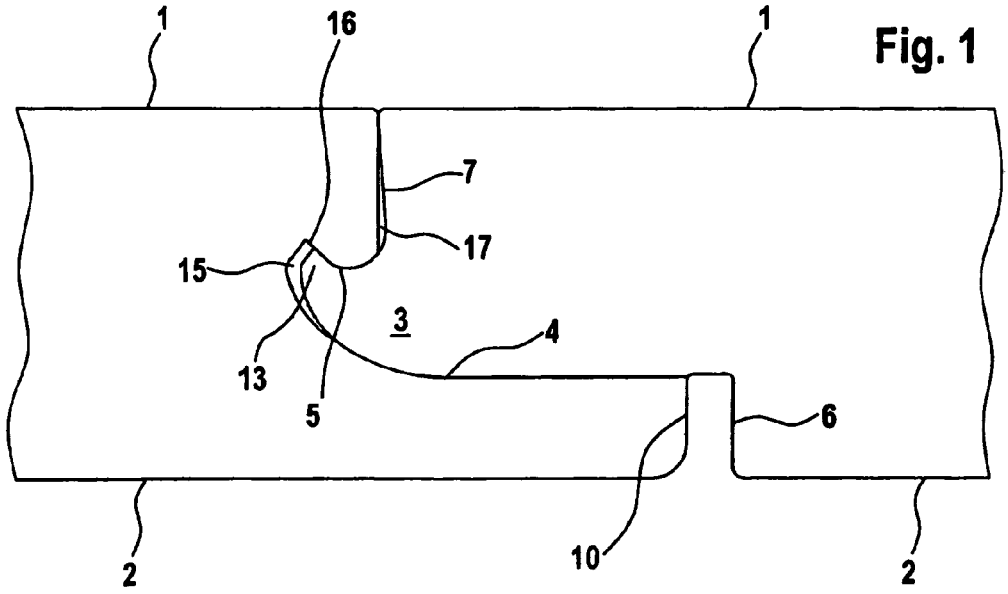
FIG. 1 shows a partial section of two panels according to the invention in the locked state, without a grooved wall region open toward the top face.

As shown for the right panel by way of example in FIG. 1, the tongue 3 divides the panel into a bottom edge portion 6 and a top edge portion 7. The bottom edge portion 6 is recessed inward from the top edge portion 7.

The oppositely situated edge is designed so that it fits with the tongue 3. At this location a groove 8 is provided that is flanked by an upper panel edge region 9 and a lower panel edge region 10. The lower panel edge region 10 projects past the upper panel edge region 9.

In the embodiments illustrated in FIGS. 1, 11 through 13, 16, and 18, in the region adjacent the bottom edge portion 6 the lower tongue surface 4 has a region that is oriented parallel to the top face 1. At its free end the lower partial surface 4 of the tongue 3 has a convex design. In the embodiments according to FIGS. 2 through 9 and 14 the lower tongue surface 4 has a convex curvature essentially over its entire length. In FIG. 10 the lower tongue surface 4 is composed of two planar surfaces 4*a* and 4*b* extending at an oblique angle to each other. In FIG. 15 the lower tongue surface 4 likewise has a convex design only at its free end.

Figure 13:
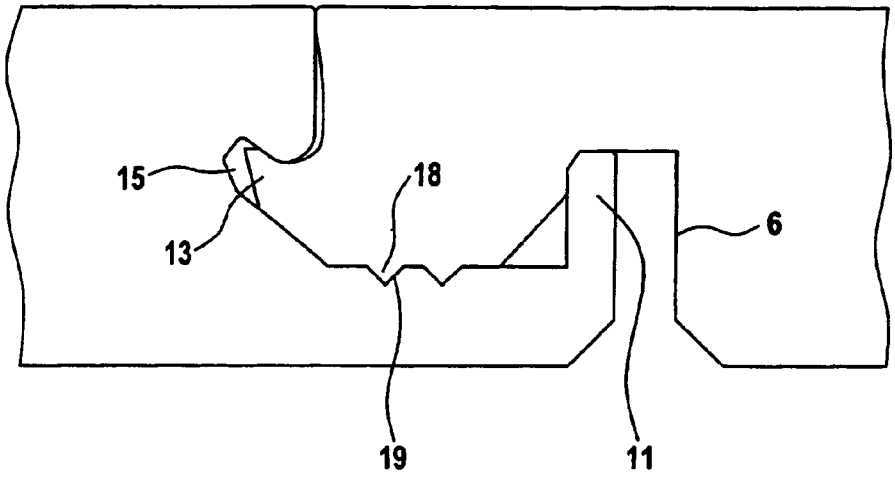

The lower tongue surfaces 4 in the embodiments according to FIGS. 11 and 13 are each oriented essentially parallel to the top face 1, and each lower tongue surface 4 at its two ends is angled up toward the top face 1.

In the embodiments according to FIGS. 2 through 11, 13, 15, and 17, the lower panel edge region 10 has a projecting grooved wall region 11, projecting toward the top face 1 of the panel, and that in FIG. 11, for example, has an upper surface extending parallel to the top face 1. In FIGS. 2 through 11 and 13, in the connected state of two panels as the result of pivoting in, the grooved wall region 11 cooperates with an undercut 12 in the adjacent panel. FIG. 15 illustrates a variant in which the grooved wall region 11 is located inside the edges of the undercut 12 of the adjacent panel without making contact. However, the outer face of the lower tongue surface 4 may also rest on the grooved wall region 11 like a bearing.

In the embodiments illustrated in FIGS. 2 through 9 and 14, the lower tongue surface 4 has a convex curvature, whereas the upper tongue surface 5 is oriented approximately parallel to the top face 1 of the panel. As shown in the figures, in the embodiments illustrated here the upper tongue surface 5 is much shorter, i.e. narrower, than the lower tongue surface 4.

In the embodiments illustrated in the figures, a projection 13 is provided on the tongue 3 at its upper tongue surface 5, the projection having a contact surface 14 directed rearward toward the top edge portion 7, and a surface 14*a* directed toward the free end of the tongue 3.

The upper panel edge region 9 of the adjacent panel on its bottom face has a recess 15 with a countersurface 16 that corresponds to the projection 13. In the pivoted-in state the countersurface 16 cooperates with the contact surface 14. When in the connected state as the result of pivoting in, the panels are thus pulled together due to cooperation of the contact surface 14 and the countersurface 16, thereby producing a gap-free connection between adjacent panels at the top face 1. The connection is free of play perpendicular (arrow S) to the orientation of the surfaces of the edge portions.

In the embodiments illustrated in FIGS. 1, 14, 15, and 18 through 22, two adjacent panels are pulled together solely by the cooperation of the contact surface 14 and the countersurface 16.

In the embodiments illustrated in FIGS. 2 through 11, 13, and 17, two adjacent panels are doubly locked due to the fact that a positive-fit connection results on the one hand between the projection 13 and the recess 15, and on the other hand between the grooved wall region 11 of the lower panel edge region 10 and the undercut 12.

Figure 2:
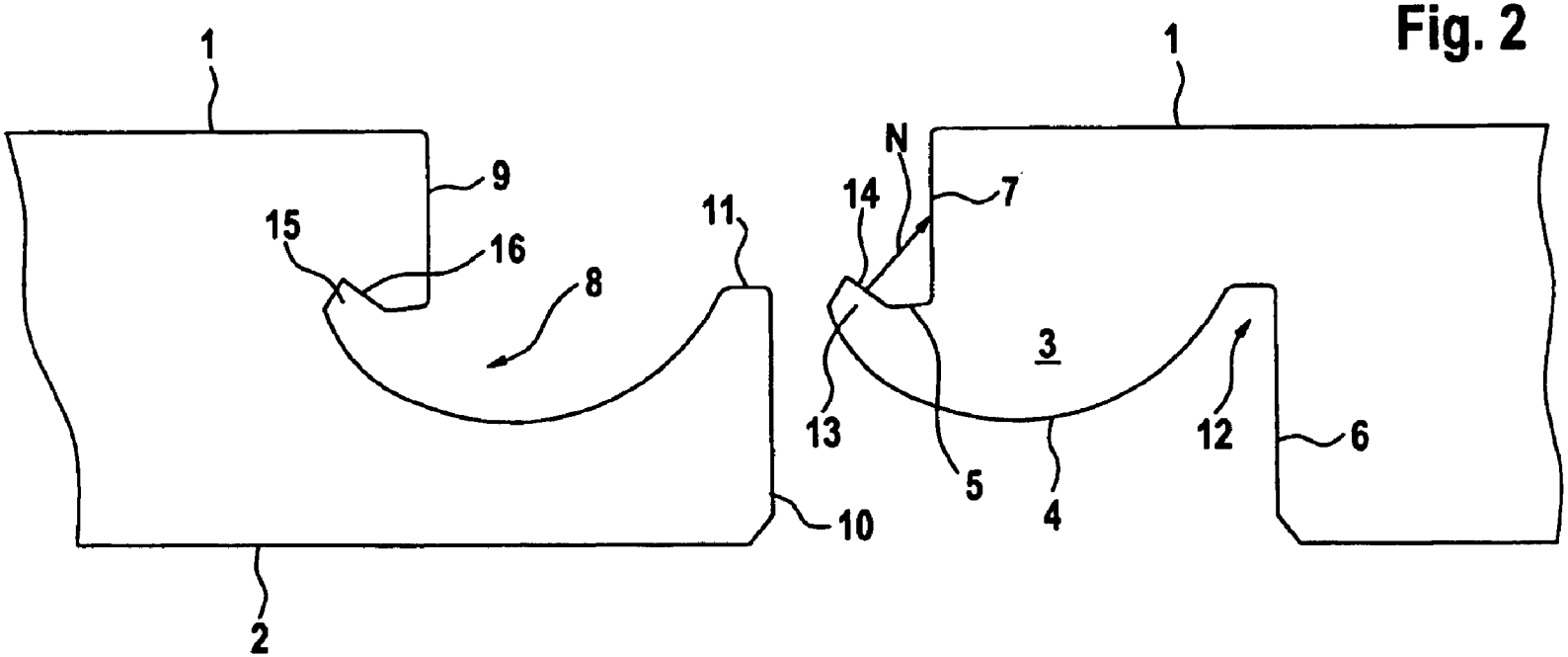
FIG. 2 shows a partial view of two panels according to the invention in the unlocked state.

In the embodiments illustrated in FIGS. 1 and 2, the projection 13 and the recess 15 have an approximately triangular shape. This is also the case in FIGS. 3 through 6 and 10 through 15.

Figure 7:
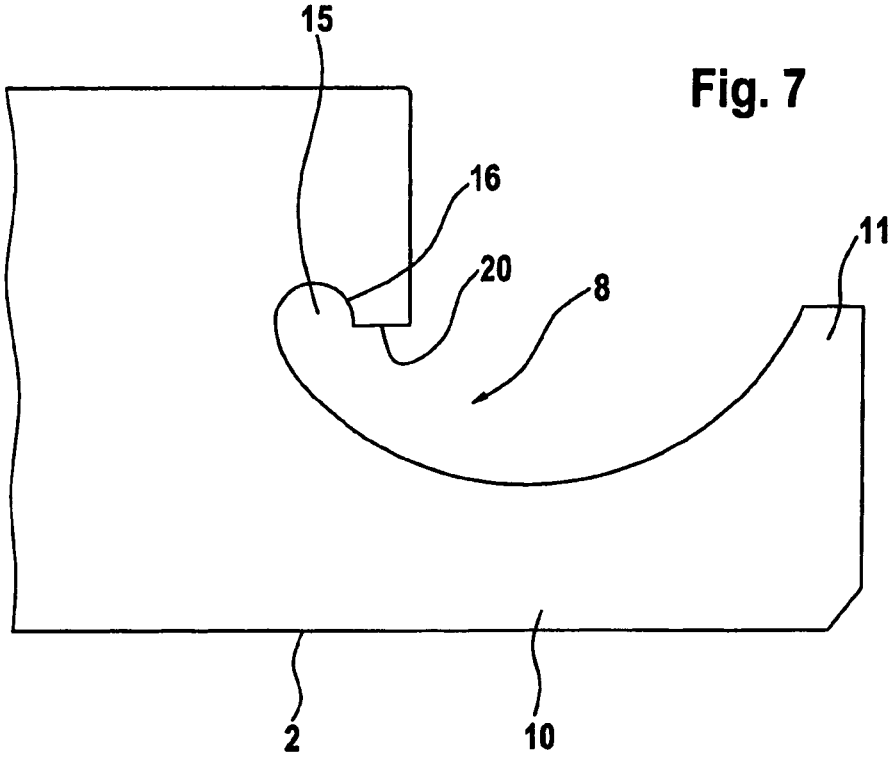
FIGS. 7-9 show different designs of a panel according to the invention.
Figure 8:
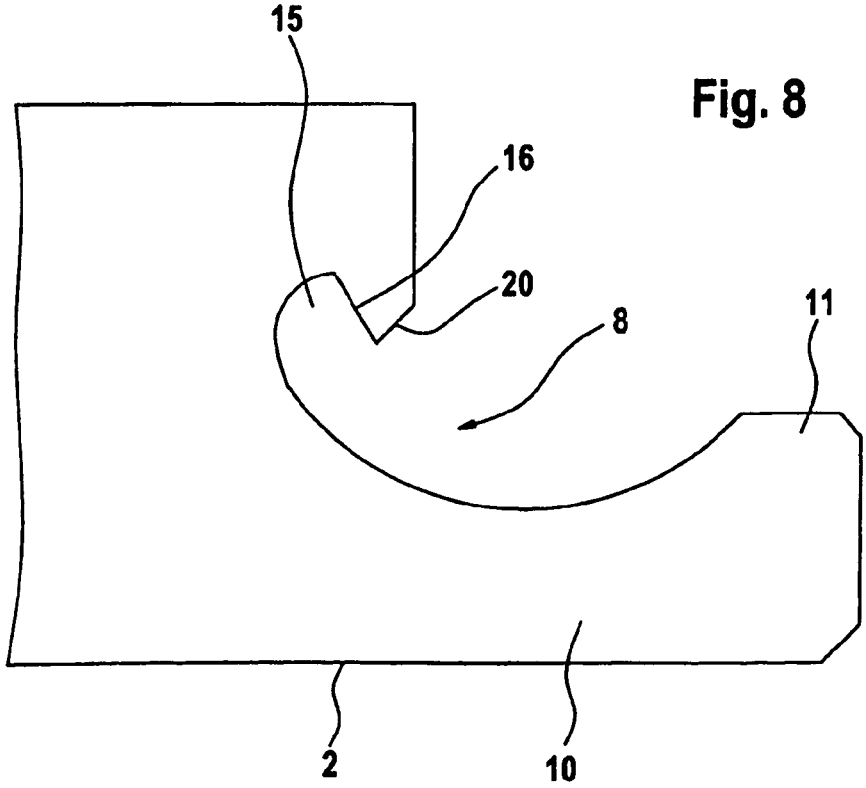
Figure 9:
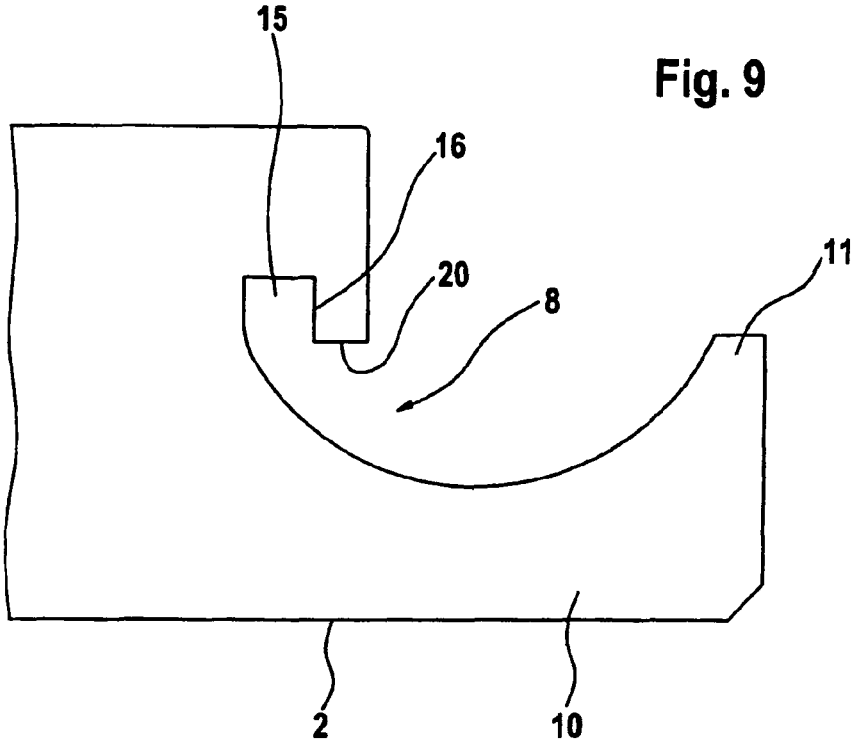
Figure 10:
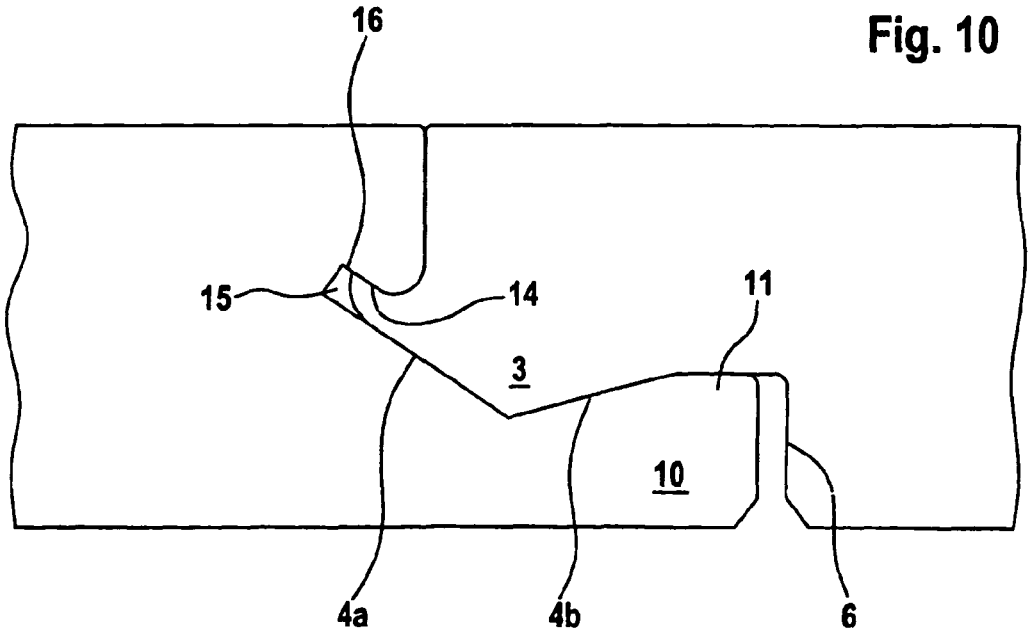

Other embodiments are illustrated in FIGS. 7 through 9. In FIG. 7 an somewhat semicircular recess is illustrated, and in FIG. 9, a rectangular recess. FIG. 9 shows an embodiment in which only the countersurface 16 has a planar design, the remaining shape of the recess 15 being curved.

For a satisfactory lock it is advantageous for the slope of the contact surface 14 to be steep enough so that the panels when pivoted in are pulled together due to cooperation of the contact surface 14 and the countersurface 16.

In the embodiment illustrated by way of example in FIG. 5, the top edge portion 7 is recessed in the partial region adjacent the upper tongue surface 5. The upper panel edge region 9 of the adjacent panel also has a similar recess. In this manner a cavity 17 is produced. The circular path of the convex lower tongue surface 4 of the tongue 3 in FIG. 5 has different radii A and B.

Figure 3:
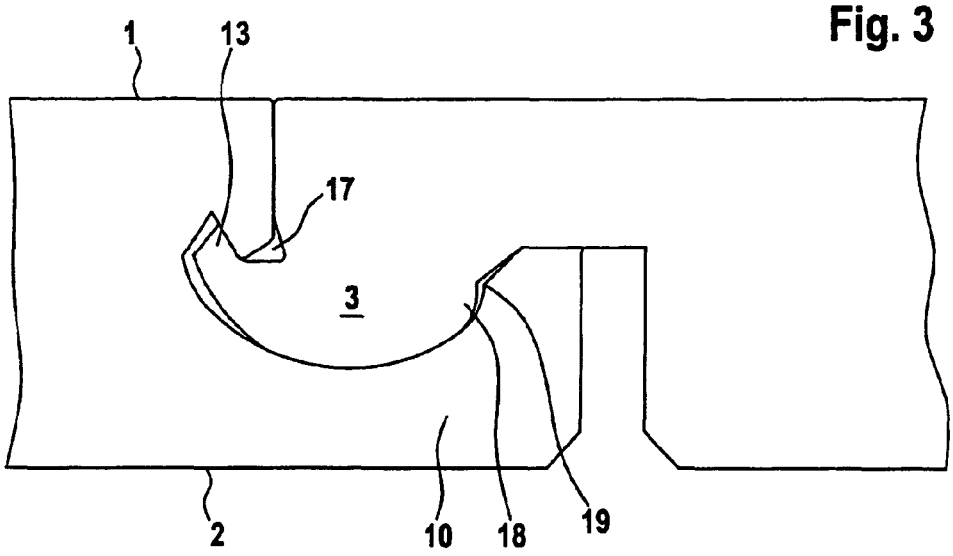
FIGS. 3-5 show partial views of pairs of panels according to the invention in the locked state.
Figure 4:
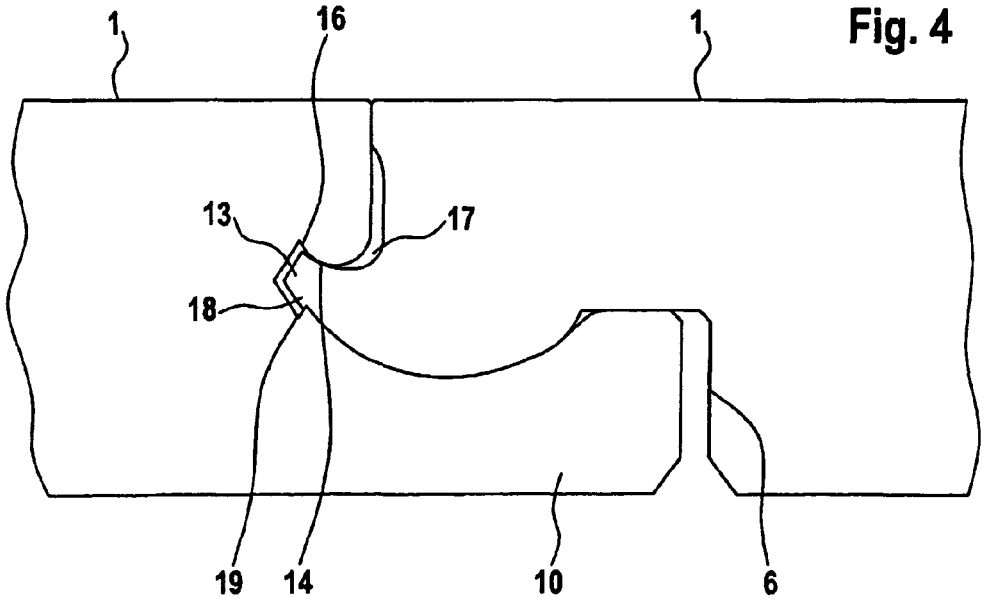

FIGS. 3 and 4 illustrate an embodiment in which the lower tongue surface 4 of the tongue 3 is provided with a locking element 18 that engages in a locking recess 19 provided in the top face of the lower panel edge region 10. FIG. 13 shows an embodiment in which the lower tongue surface 4 is provided with two locking elements 18, and at the top face of the lower panel edge region 10 is provided with two locking recesses 19.

A reverse configuration is illustrated in FIG. 12. In this case three locking elements 18 are provided at the top face of the lower panel edge region 10 that engage in corresponding locking recesses 19 in the lower tongue surface 4.

The locking element 18 may be designed as an integrally molded region that projects with respect to the lower tongue surface 4 of the tongue 3. Alternatively, the locking element 18 may also be provided as part of the tongue 3, as illustrated in FIG. 4, by means of an undercut region so that it lies within the circular path of the lower tongue surface 4.

In the embodiment illustrated in FIG. 3, the cross section of the locking element 18 has an somewhat curved shape, and is situated in the partial region of the lower tongue surface 4 adjacent the undercut 12.

In the embodiment illustrated in FIG. 4, the locking element 18 is provided at the free end of the tongue 3, and the locking recess 19 is provided in the corresponding region in the lower panel edge region 10.

Figure 6:
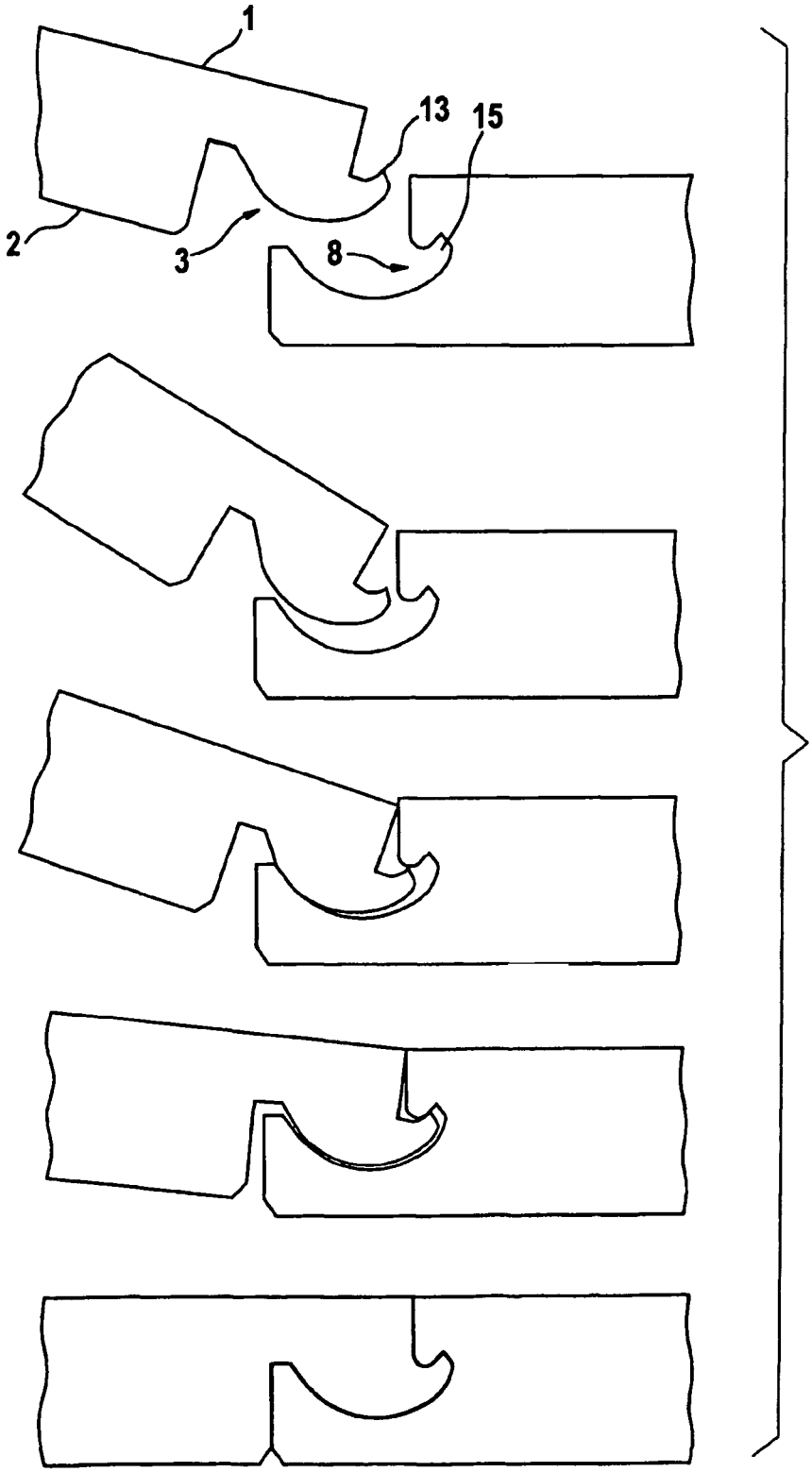
FIG. 6 shows a pivoting-in procedure illustrated in five different positions.

The installation, i.e. the pivot motion, is illustrated in five views according to FIG. 6. As shown in these diagrams, the panels may be locked together by a simple pivot motion.

FIGS. 7 and 9 and also FIG. 8 illustrate different designs of the region 20 near the upper tongue surface 5 and extending between the upper panel edge region 9 and the countersurface 16 of the recess 15. Thus, in FIG. 8 the adjacent region 20 has a slanted design, whereas FIGS. 7 and 9 show a parallel orientation of the adjacent region 20 with respect to the top face 1.

FIG. 7 shows by way of example an embodiment in which the distance of the grooved wall region 11 from the bottom face 2 of the panel is greater than the distance of the region 20 from the bottom face. The groove 8, viewed in the direction parallel to the top and bottom faces 1 and 2, is thus covered by the grooved wall region 11. In FIG. 9 the upper surface of the grooved wall region 11 is approximately flush with the region 20. Other designs, such as illustrated in FIG. 8, for example, are of course possible. In this case the groove 8, viewed in the direction parallel to the top and bottom faces 1 and 2, is only partially covered by the grooved wall region 11.

In the embodiments illustrated in FIGS. 1, 11 through 13, and 18, the lower tongue surface 4 for the most part is essentially parallel to the top face 1, the top face of the lower panel edge region 10 having a corresponding design. In FIGS. 11 and 13 a grooved wall region 11 is integrally molded onto the lower panel edge region 10, and has an upwardly directed weblike design that forms two parallel side flanks. When pivoted in and out, the lower panel edge region 10 is deflected downward to a certain extent. In the locking position as illustrated in FIGS. 11 and 13, however, the lower panel edge region 10 has returned to its original position.

It is obvious that the locking element(s) 18 and/or the projection 13, as illustrated in the figures, may be provided as one piece with the respective panel. Of course, a two-piece configuration is also possible, the locking element(s) 18 and/or the projection 13 being connected to the panel in question by use of suitable joining techniques such as gluing, for example.

In the embodiment illustrated in FIG. 15, the projecting grooved wall region 11 of the lower panel edge region 10 is situated in the undercut 12 of the adjacent panel in such a way that the surfaces of the grooved wall region 11 are not in contact with the corresponding surfaces of the undercut 12.

The tongue 3 at its lower tongue surface 4 has a convex design only at its free end down to the lowest point of the tongue 3. The convex design starts at the lowest point of the tongue 3 and rises toward the free end of the tongue 3.

At its lowest point, i.e. somewhat below the top edge portion 7 in this embodiment, the lower tongue surface 4 of the tongue 3 has a support surface 21 (plane "x"), oriented essentially parallel to the top face 1 of the panel, and in the region that is in contact with the support surface 21 when an adjacent panel is in the pivoted-in state, i.e. somewhat below the upper panel edge region 9, the lower panel edge region 10 has a correspondingly oriented planar complementary surface 22.

In this embodiment the width A of the support surface 21 is smaller than the width B of the complementary surface 22, so that in this embodiment as well a separation of two panels is prevented only by the cooperation of the countersurface 16 and the contact surface 14.

The projection 13 has a surface 14*a* that points toward the free end of the tongue 3. Between the surface 14*a* and the oppositely situated region 16*a* of the groove 8 there is a gap 23, which in the embodiment illustrated also extends partially around the free end of the tongue 3 into the region between the lower tongue surface 4 and the adjacent panel.

Figure 14:
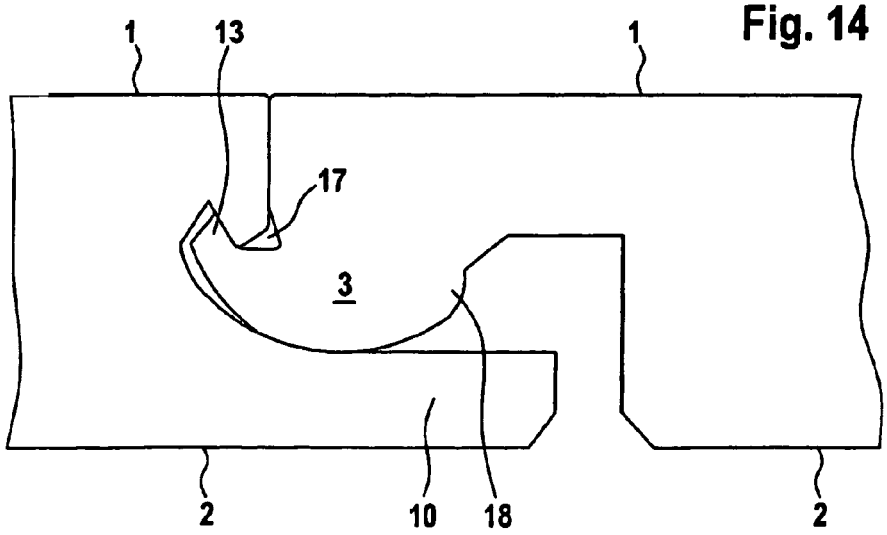
Figure 15:
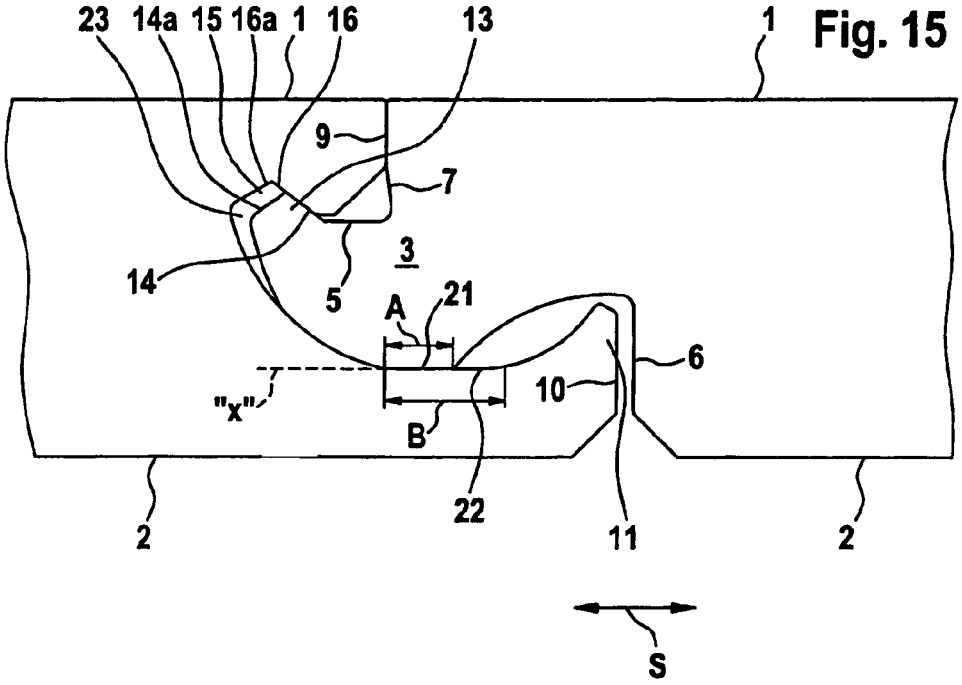

In the embodiments according to FIGS. 1, 14, and 15, a separation of two panels in the direction S is prevented only by the cooperation of the contact surface 14 and the countersurface 16.

Pressing together, i.e. further pushing against one another, of two connected panels is prevented on the one hand by cooperation between the top edge portion 7 and the upper panel edge region 9, and on the other hand by the cooperation between the lower tongue surface 4 at the convex curvature and the groove 8 in the adjacent panel.

Displacement of two mutually locked panels in a direction perpendicular to the bottom face 2 of the panel is prevented on the one hand by the cooperation of the contact surface 14 and the countersurface 16, and on the other hand by cooperation between the lower tongue surface 4 at the convex curvature and the groove 8 in the adjacent panel.

Figure 16:
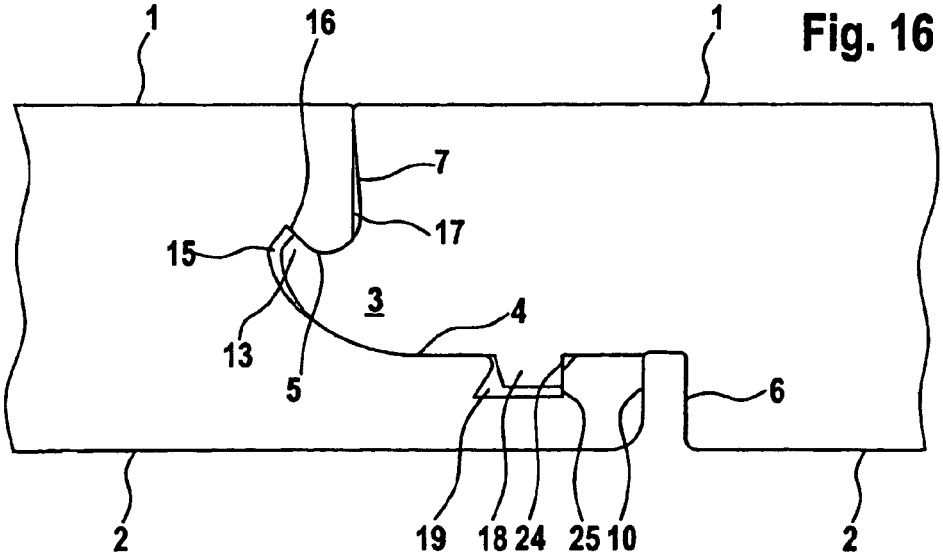

In the embodiment illustrated in FIG. 16, the free end of the lower tongue surface 4 of the tongue 3 has a convex design, which at the bottom edge portion 6 merges into an orientation extending parallel to the top face 1. In this region aligned in parallel, at the bottom face of the lower tongue surface 4 a locking ridge 18 having an approximately rectangular cross section is provided that engages in a corresponding locking recess 19 in the lower panel edge region 10. In the locked state, the effective surface 24 of the locking element 18 directed toward the bottom edge portion 6 is in contact with a corresponding locking surface 25 of the locking recess 19. This produces double locking due to the cooperation of the contact surface 14 and the countersurface 16 on the one hand and of the effective surface 24 and the locking surface 25 on the other hand.

Figure 17:
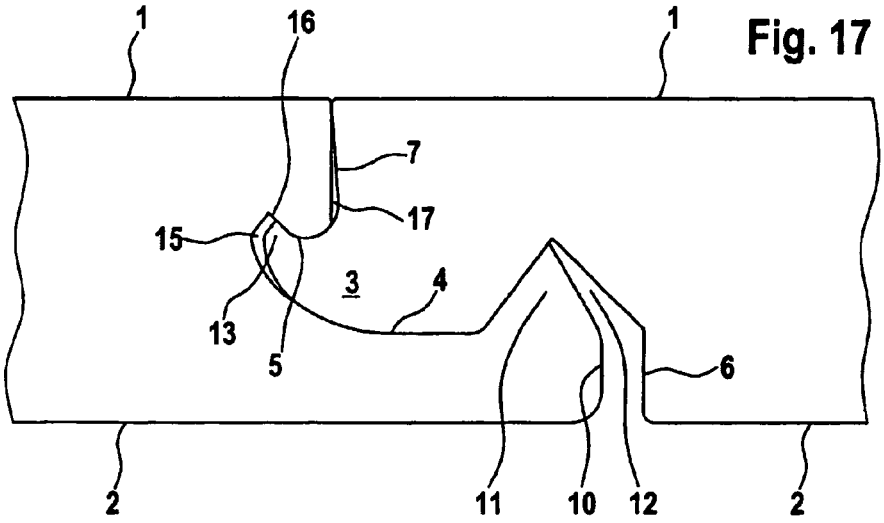

FIG. 17 illustrates an alternative design of the embodiment according to FIG. 2. Whereas in FIG. 2 the top face of the grooved wall region 11 has a surface oriented parallel to the bottom face 2, in FIG. 17 the grooved wall region 11 has an upwardly tapering design. The undercut 12 that is provided in the adjacent panel and cooperates with the grooved wall region 11 likewise has an approximately triangular shape that, however, is wider toward the bottom edge portion 6, so that a gap that widens toward the bottom face 2 of the panel remains between the free end of the lower panel edge region 10 and the oppositely situated region of the adjacent panel.

Figure 18:
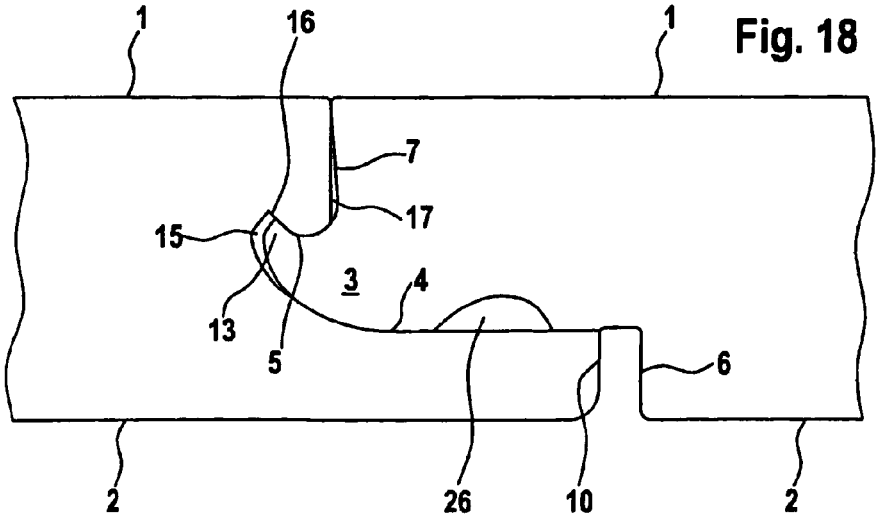

FIG. 18 illustrates an alternative embodiment of FIG. 1. In this case a recess 26 is formed in the lower tongue surface 4 in the region parallel to the bottom face 2.

Figure 19:
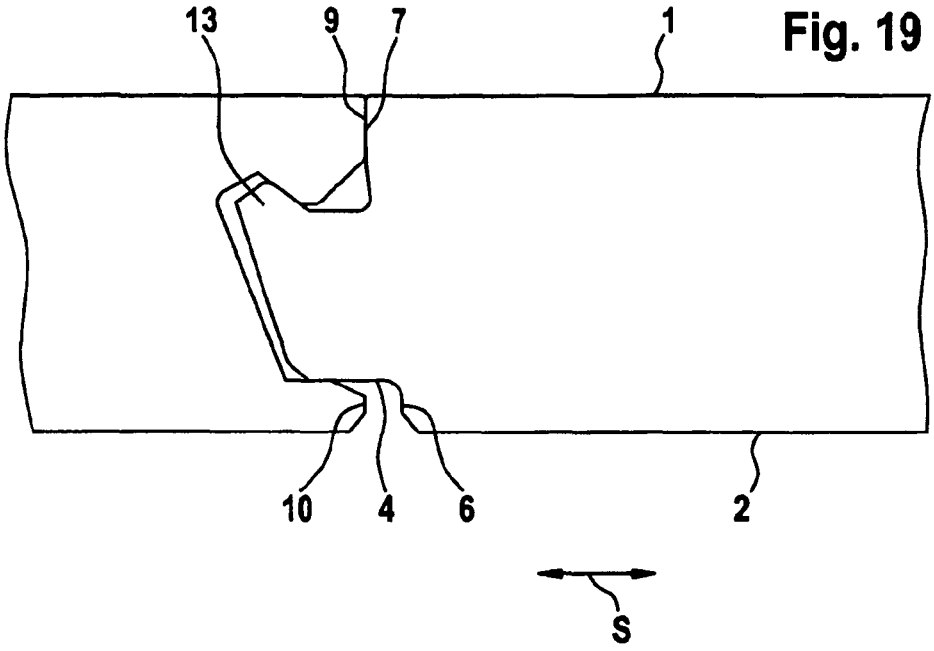

In the embodiment illustrated in FIG. 19, the upper and lower panel edge regions 9, 10 are in approximately flush alignment. The bottom edge portion 6 is recessed only slightly with respect to the top edge portion 7. The lower tongue surface 4 has, among other regions, a region oriented essentially parallel to the bottom face 2 of the panel, and from there ascends obliquely toward the free end. The corner of the lower panel edge region 10 facing the lower tongue surface 4 is slightly beveled to simplify pivoting in.

Figure 20:
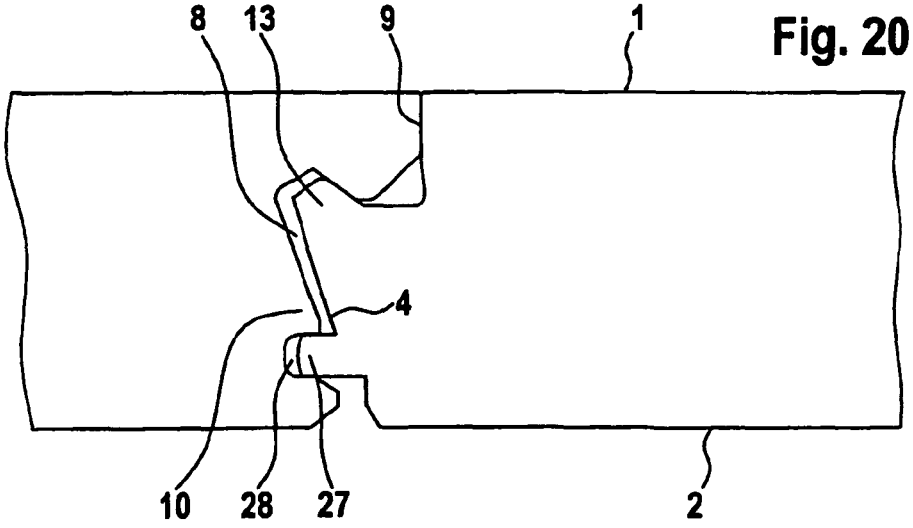

FIG. 20 shows a further embodiment in which the upper panel edge region 9 projects relative to the lower panel edge region 10. In this embodiment the lower tongue surface 4 has a stepped design that in the illustrated embodiment has two steps, forming a projecting region 27. This projecting region 27 has two surfaces that are oriented essentially parallel to the bottom face 2. In the locked state the projecting region 27 engages in a corresponding recess 28 in the adjacent panel.

Figure 21:
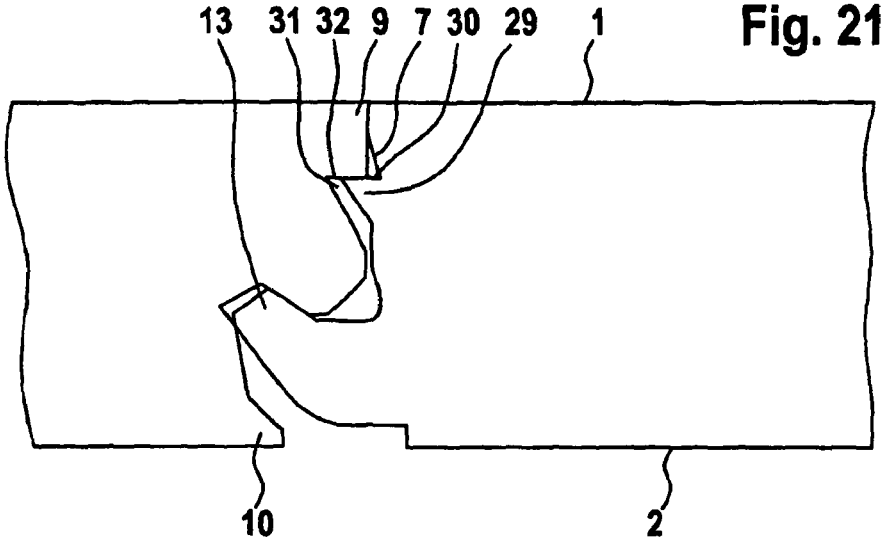

In the embodiment illustrated in FIG. 21, a laterally projecting region 29 is integrally molded onto the top edge portion 7, and has a surface 30 that is oriented essentially parallel to the top face 1 and points toward the top face 1. In the upper panel edge region 9 the adjacent panel has a corresponding seat 31 with a support surface 32 that is likewise oriented approximately parallel to the top face 1. In the pivoted-in state the surface 30 of the projecting region 29 rests against the support surface 32 of the seat 31, thereby ensuring additional locking perpendicular to the top face 1 of the panels.

Figure 22:
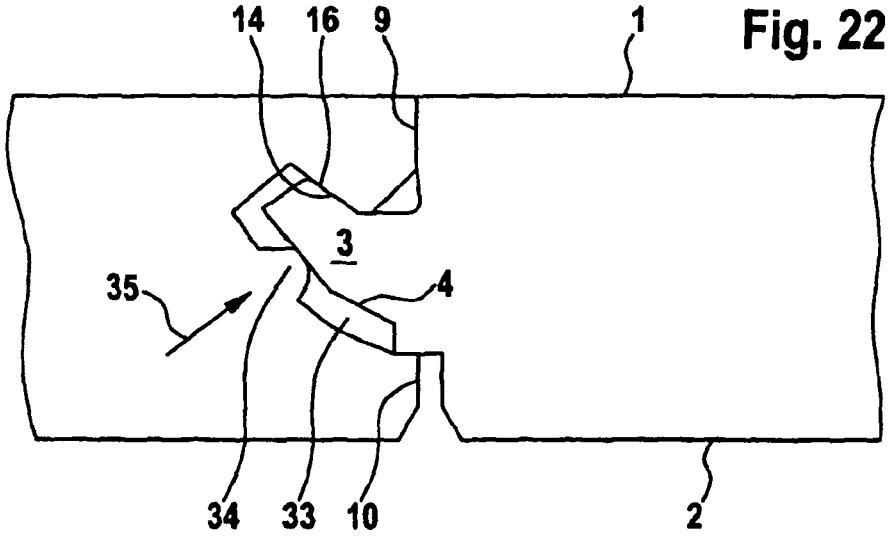

FIG. 22 illustrates an embodiment in which the upper and lower panel edge regions 9, 10 are in flush alignment. Toward its free end the width of the tongue 3 is narrower than the width of the groove 8, so that in the pivoted-in state a free space 33 is created between the lower tongue surface 4 and the lower panel edge region 10. On the top face of the lower panel edge region 10, in the region in which the free space 33 is located, a press-on element 34 is therefore also provided that in the pivoted-in state is in contact with the lower tongue surface 4. In the pivoted-in state this causes the press-on element 34 to exert a force on the tongue 3 toward the arrow 35.

The invention claimed is:

1. A panel having a top face and a bottom face, opposite first and second longitudinal edges, opposite first and second transverse edges, and means for detachably connecting the panel to an identical adjacent panel by pivoting, the means comprising:

a tongue provided on at least one of the first longitudinal edge and the first transverse edge of the panel so as to project beyond the respective one of the first longitudinal edge and the first transverse edge;

the tongue having lower and upper tongue surfaces that divide the at least one of the first longitudinal and the first transverse edge into a top edge portion and a bottom edge portion, at least a portion of the lower tongue surface having a convex curvature;

one of the second longitudinal edge and the second transverse edge having a groove corresponding to the tongue of the adjacent panel, the groove flanked by upper and lower panel edge regions of the panel;

the lower panel edge region projecting toward the upper panel edge region, and the bottom edge portion being recessed with respect to the top edge portion;

the tongue on the upper tongue surface having a projection with a contact surface directed rearward in a direction toward the top edge portion such that an angle between a normal to the contact surface and the top face being an oblique angle, and the upper panel edge region having on a lower side thereof a recess at least partially accommodating the projection and having a countersurface;

the countersurface in a pivoted-in state cooperating with the contact surface of the adjacent panel so that the panels in the connected state as the result of pivoting-in have a connection that is free of play in the direction perpendicular to the orientation of the surfaces of the edge portions; and the panels when connected by pivoting-in are pulled together due to the cooperation of the contact surface and the countersurface of the panel and the adjacent panel.

2. The panel according to claim 1, wherein the lower panel edge region has a grooved wall region that projects toward the top face of the panel and cooperates with an undercut, provided on the adjacent panel, in the connected state of the two panels as the result of pivoting in.

3. The panel according to claim 1, wherein the lower panel edge region has a grooved wall region that projects toward the top face of the panel and that, in the connected state of the two panels as the result of pivoting in, is located in an undercut provided on the adjacent panel without the surfaces of the grooved wall region contacting the corresponding surfaces of the undercut.

4. The panel according to claim 1, wherein the projection has an approximately triangular shape.

5. The panel according to claim 1 wherein the projection has an approximately curved shape.

6. The panel according to claim 1, wherein at least one of the upper panel edge region and the top edge portion, at least in a partial region, has an inwardly extending recess forming a cavity between the upper panel edge region and the top edge portion of the panel and the adjacent panel.

7. The panel according to claim 1, wherein the lower tongue surface of the tongue at a free end thereof has a convex curvature.

8. The panel according to claim 7 wherein the convex lower tongue surface has a uniform curvature.

9. The panel according to claim 7, wherein the convex curvature of the lower tongue surface has at least two different radii.

10. The panel according to claim 1 wherein the tongue at its lower tongue surface has a convex curvature only at its free end.

11. The panel according to claim 1, wherein the lower tongue surface of the tongue has a support surface oriented essentially parallel to the top face of the panel at the lowest point, and wherein the lower panel edge region has a correspondingly oriented planar complementary surface in the region that in the pivoted-in state with the adjacent panel is in contact with the support surface.

12. The panel according to claim 1, wherein the projection has a surface directed toward a free end of the tongue, and wherein a free space is formed between the tongue of the panel and the surface of the groove of the adjacent panel.

13. The panel according to claim 1, wherein the tongue on its lower tongue surface has a locking recess, and a top face of the lower panel edge region has a locking element that cooperates with the locking recess of the adjacent panel when the panels are joined together.

14. The panel according to claim 1, wherein the upper tongue surface is oriented parallel to the top face of the panel.

15. The panel according to claim 1 wherein the upper tongue surface has an arched design toward the top face or the bottom face.

* * * * *